United States Patent [19]

Stackhouse

[11] Patent Number: 4,557,365

[45] Date of Patent: Dec. 10, 1985

[54] COIN OPERATED LOCK UNIT

[75] Inventor: Wells F. Stackhouse, Leesburg, Fla.

[73] Assignee: American Locker Security Systems, Inc., Jamestown, N.Y.

[21] Appl. No.: 561,237

[22] Filed: Dec. 14, 1983

[51] Int. Cl.[4] ..... G07F 5/04

[52] U.S. Cl. ..... 194/1 G; 194/102

[58] Field of Search ..... 194/51, 59, 65, 102, 194/54, 1 G, 1 L

[56] References Cited

U.S. PATENT DOCUMENTS

| | | | |
|---|---|---|---|
| 2,437,742 | 3/1948 | Hofmann | 194/1 G |
| 2,957,568 | 7/1955 | Gabrielsen | 194/18 |
| 2,996,163 | 7/1956 | Baker, Jr. | 194/37 |
| 3,050,169 | 2/1960 | Stackhouse | 194/19 |
| 3,193,074 | 10/1961 | Stackhouse | 194/92 |
| 3,228,506 | 1/1963 | Stackhouse | 194/92 |
| 3,559,770 | 8/1971 | Stackhouse | 194/92 |
| 3,613,855 | 10/1971 | Stackhouse | 194/51 |
| 3,773,158 | 8/1971 | Wada | 194/32 |
| 3,841,458 | 10/1974 | Kinoshita | 194/32 |
| 3,917,046 | 11/1975 | Yorisue | 194/9 |
| 3,938,640 | 2/1976 | Stackhouse | 194/92 |
| 4,072,223 | 2/1978 | Kinoshita | 194/54 |
| 4,384,641 | 5/1983 | Stackhouse | 194/92 |
| 4,423,805 | 1/1984 | Barth | 194/1 G |

*Primary Examiner*—Stanley H. Tollberg

*Attorney, Agent, or Firm*—Bean, Kauffman & Bean

[57] ABSTRACT

A lock unit for a coin operated locker cabinet or the like incorporates an improved arrangement for permitting a custodian to selectively, releasably retain the lock unit within a cabinet mounting post and to control a patron lock for cabinet door unlocking/locking purposes, while a patron key is removed from the patron lock. The lock unit additionally incorporates an improved coin gauging and counting mechanism adapted to selectively accommodate the lock unit for operation by one or more coins of a given denomination and improved construction for adapting a coin chute to coins of different diameters.

35 Claims, 16 Drawing Figures

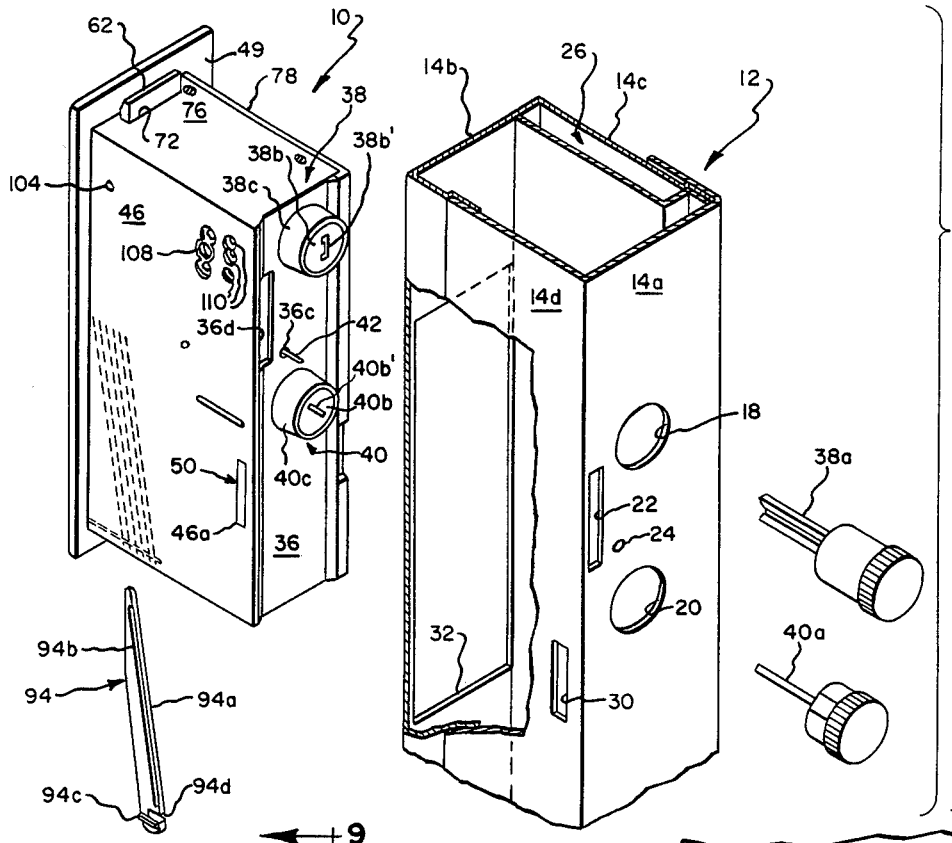
Fig. 1.
Fig. 2.
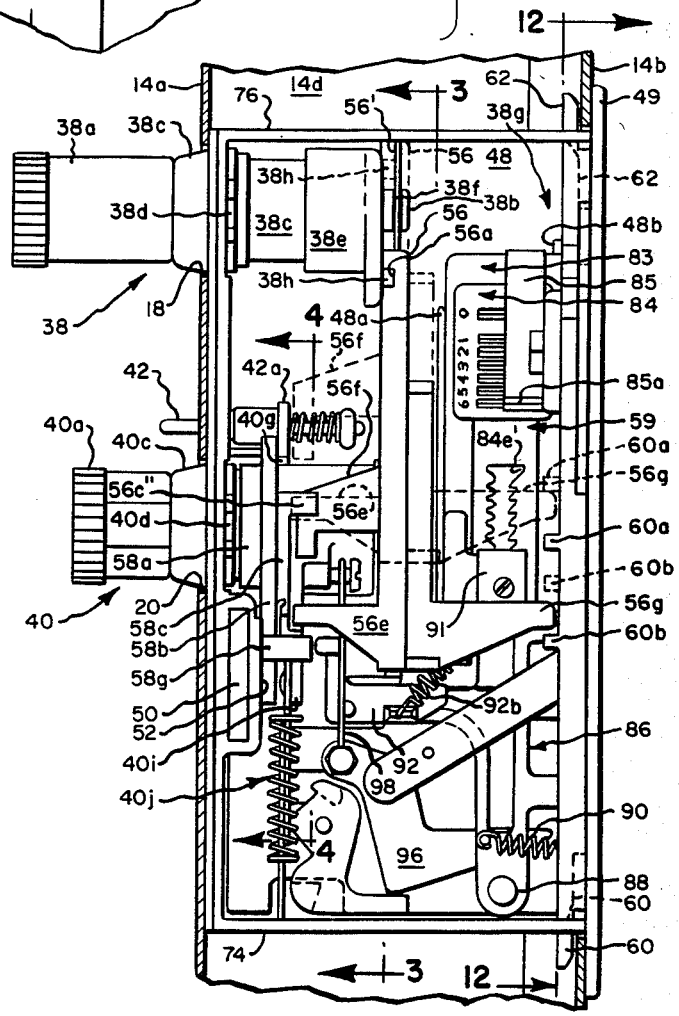
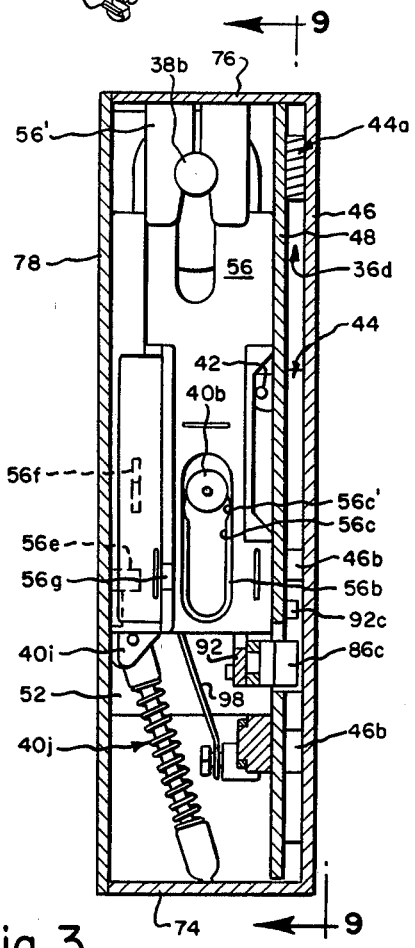
Fig. 3.

Fig. 7.
PRIOR ART
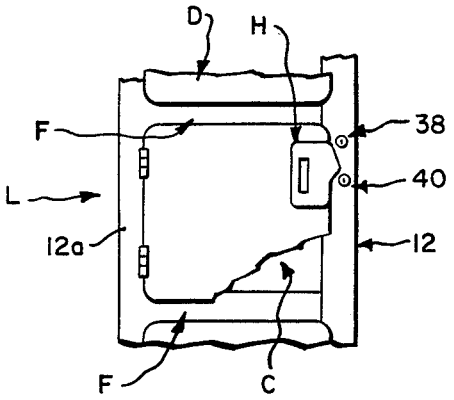
Fig. 6b.
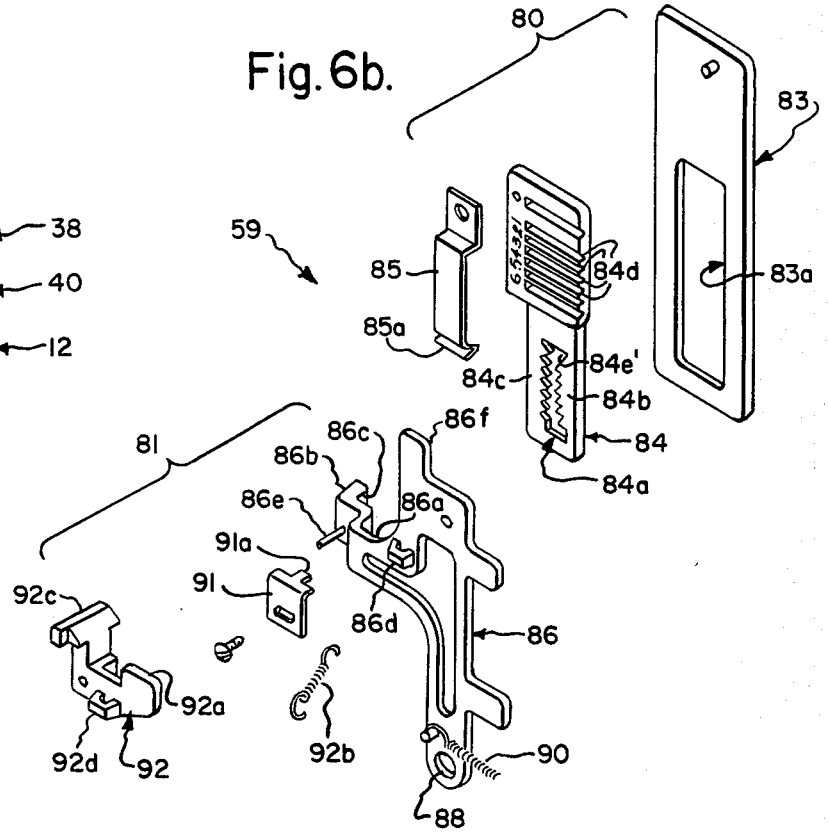
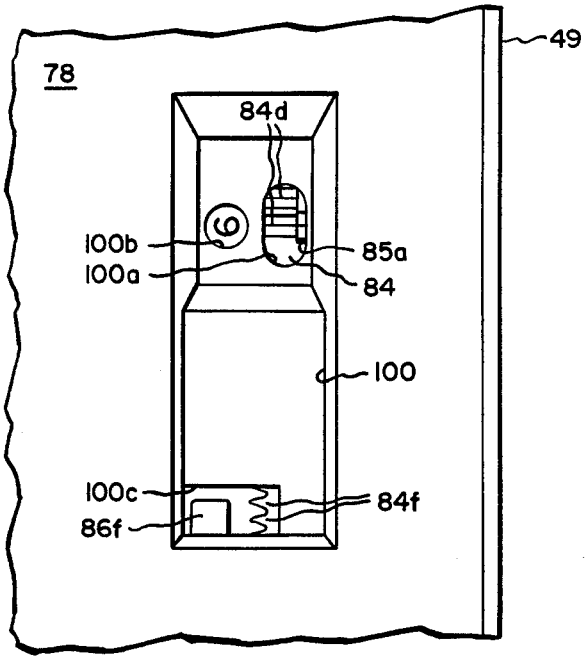
Fig. 8.

Fig. 12.
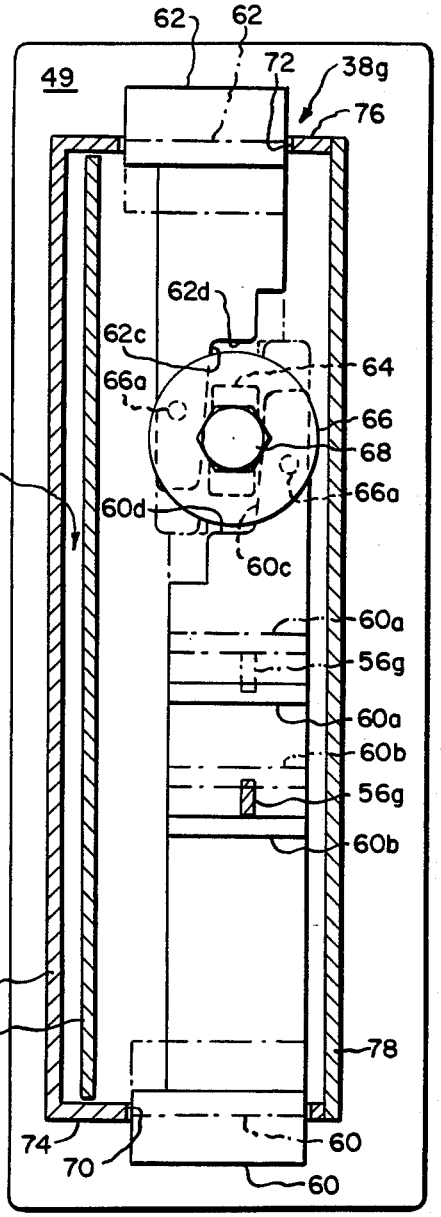
Fig. 9.
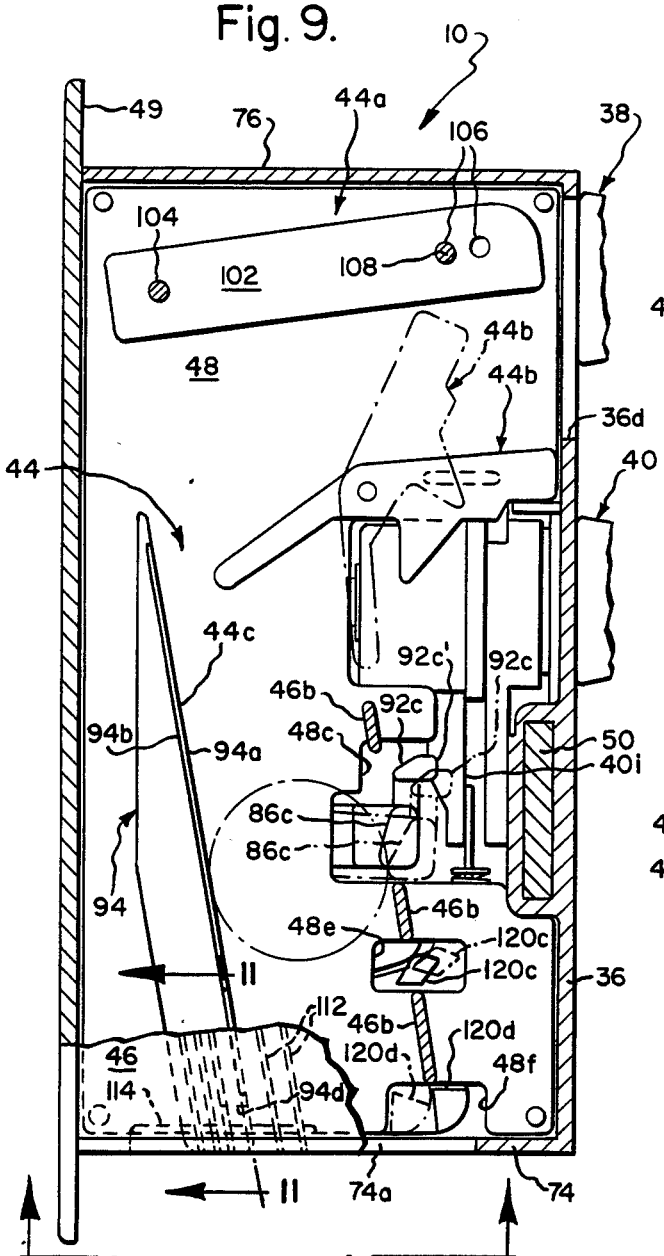
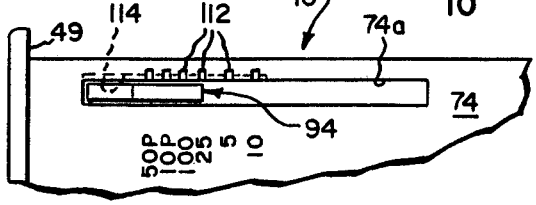
Fig. 10.
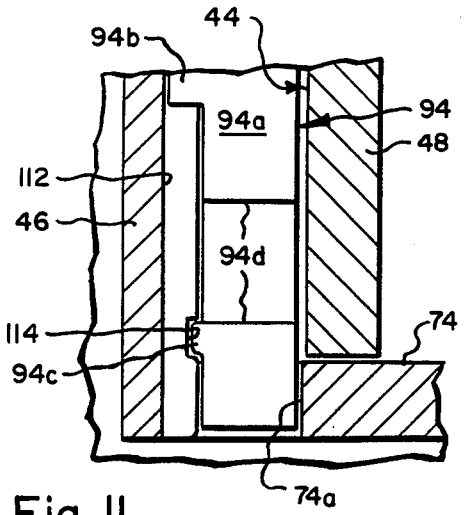
Fig. 11.

COIN OPERATED LOCK UNIT

BACKGROUND OF THE INVENTION

The present invention is generally directed towards improvements in lock units of the type adapted for use with a coin operated locker cabinet.

In my prior U.S. Pat. No. 4,384,641, there is described an arrangement permitting a custodian to selectively, releasably and securely retain a lock unit within a mounting post of a coin operated locker cabinet and to control a patron lock for cabinet door unlocking/locking purposes, while a patron key is removed from the patron lock and unavailable for door unlocking purposes.

In pending U.S. patent application Ser. No. 288,008 filed July 29, 1981, there is described a Ratchet Escapement Coin Counter Mechanism adapted to selectively accommodate a lock unit for operation by one or more coins of a given denomination, characterized in that a pre-selected number of coins of such given denomination may be counted, regardless of the total number or denomination of coins actually deposited in the coin chute with which said mechanism is associated.

In my prior U.S. Pat. No. 3,938,640, there is disclosed a coin operated lock unit having spacer bars removably fitted within a coin chute for purposes of accommodating the lock for coins of differing diameter.

SUMMARY OF THE INVENTION

The present invention is directed towards an improved lock unit particularly adapted for use with coin operated locker cabinets.

In accordance with the present invention, a lock unit is provided with a drive mechanism for removably coupling a lock barrel of a patron lock to a lock bolt to normally provide for movement of the lock bolt between its cabinet door unlocked and locked positions under the control of a patron lock key in combination with means under the control of a custodian lock for effecting movements of the lock bolt independently of the patron lock barrel between its locked and unlocked positions, while the patron key is removed from the patron lock and unavailable for use.

In a preferred form of the invention the means under the control of the custodian lock is also adapted for use in removably installing the lock unit within the locker cabinet and removably securing the lock cylinder of the patron lock with its housing.

The lock unit of the present invention additionally incorporates an improved ratchet type, coin gauging and counting mechanism, which is selectively adjustable to accommodate the lock unit for operation by one or more coins. The construction of the present mechanism is unique in several respects including its use of a coin gauging member whose construction permits its direct control of locking rotations of a patron lock to thereby permit a reduction in parts of lock units of the type described in U.S. Pat. No. 4,384,641, and its adjustment means, which is arranged and constructed to permit custodian access thereto for adjustment purposes through an otherwise sealed casing or protective housing of the lock unit.

The present lock unit additionally incorporates improved means under custodian control for adjustably controlling the width of a coin chute, as required to accommodate the lock unit for operation by coins of different diameter.

DRAWINGS

The nature and mode of operation of the present invention will now be more fully described in the following detailed description taken with the accompanying drawings wherein:

FIG. 1 is an exploded perspective view of a lock unit and its associated mounting post;

FIG. 2 is a side elevational view of a lock unit mounted within the mounting post with a lock housing side plate removed;

FIG. 3 is a sectional view taken generally along the line 3—in FIG. 2;

FIG. 6B is an exploded perspective view of the mechanism shown in FIG. 5;

FIG. 7 is a fragmentary front elevational view of a locker cabinet embodying the present invention;

FIG. 8 is a fragmentary view of the lock unit side plate showing access for adjusting the mechanism shown in FIG. 5;

FIG. 9 is a sectional view taken generally along the line 9—9 in FIG. 3;

FIG. 10 is a fragmentary bottom plan view of the lock unit taken generally along line 10—10 in FIG. 9;

FIG. 11 is a sectional view taken generally long the line 11—11 in FIG. 9; and FIG. 12 is a sectional view taken generally along the line 12—12 in FIG. 2.

DETAILED DESCRIPTION

Figure 4A:
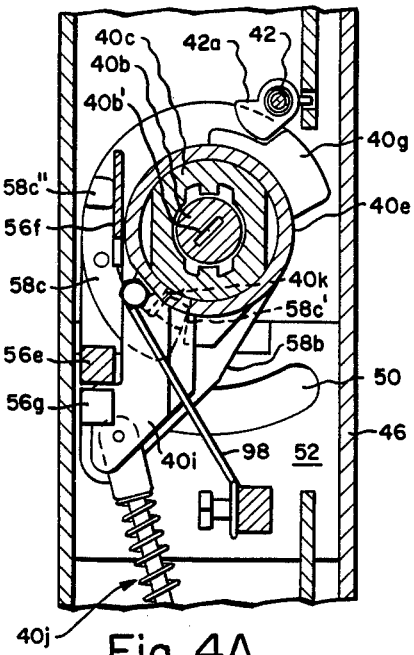
FIG. 4A is a sectional view taken generally along the line 4—4 in FIG. 2 showing the lock unit in unlocked condition.

Reference is first made to FIG. 1, wherein a lock unit formed in accordance with the present invention is generally designated as 10 and shown in disassembled association with a mounting post 12 forming a portion of the frame of an otherwise typical coin operated locker cabinet designated as "L" only in FIG. 7. Cabinet "L" may include one or more upright lock unit mounting posts, which cooperate with each other and/or a hinge mounting post 12*a* to horizontally bound one or more columns of storage compartments "C", wherein the compartments of each column are vertically separated by horizontal frame members "F" extending between such posts. The forwardly facing access openings of the storage compartments are selectively closed by suitable doors "D", which are hingedly secured to the hinge mounting post, and to intermediate ones of the lock unit mounting posts for instances where the locker cabinet is provided with more than one column of storage compartments, and selectively and releasably secured in locked or storage compartment closed condition by associated lock units spaced vertically of each lock unit mounting post in horizontal alignment with the storage compartments.

As in my commonly assigned U.S. Pat. No. 4,384,641, whose disclosure is specifically incorporated by reference therein, mounting post 12 may be suitably fabricated to provide a rigid box beam construction having forwardly and rearwardly facing flange portions 14*a* and 14*b*, and a pair of side flange portions 14*c* and 14*d*. Front flange portion 14*a* is intended to be exposed for view from the front of the locker cabinet and characterized as having vertically spaced groups of apertures, only one group being illustrated in the drawing, wherein each group of apertures is intended to accommodate one of lock units 10 for operative association with the door of an adjacently disposed storage compartment. Each group of apertures would preferably include custodian and patron lock locating apertures 18 and 20, respectively; a coin insertion slot 22; and a patron lock release rod receiving aperture 24. Additional apertures may be provided in each group for permitting viewing of a counter-mechanism and the return of coins, if required by the design of the lock units to be fitted within mounting post 12. Front flange 14*a* would also normally be provided with an opening, not shown, disposed adjacent its lower end for purposes of affording custodian access to a coin box or collecting chamber, also not shown, adapted to receive and store coins after passage thereof downwardly within the mounting post with the aid of a coin chut 26 formed, as by way of example, by welding the edges of a plate 28 to inner surfaces of the mounting post.

Flange portion 14*c* is intended to be suitably fixed to an exterior side panel of the locker cabinet, or for the case whee the locker cabinet includes more than one column of storage compartments, may serve as a part of a hinge support assembly for the doors of a next adjacent column. On the other hand, flange portion 14*d* of each mounting post serves to bound the access openings of an operably adjacent column of storage compartments, thereby necessitating that flange portion 14*d* be formed with lock bolt receiving slots 30 arranged one in association with each of the above described groups of apertures. Rear flange portion 14*b* is formed with vertically elongated and generally rectangular mounting openings 32, which are provided one in association with each of the above mentioned groups of apertures or storage compartments and sized to permit removable insertion of one of lock units 10 therethrough for positioning within the confines of mounting post 12 in the manner shown in FIG. 2. Rear flange portion 14*b* is accessible for lock unit insertion/removal purposes from within the confines of the individual storage compartments, but nonetheless spaced substantially inwardly of the access openings of such compartments, such as to be normally obscured from view and in any event render it exceedingly difficult for unauthorized individuals to use tools, such as a pry bar, to effect removal of a lock unit from within mounting post 12 through its mounting opening 32.

Lock unit 10 is similar in basic construction to that described in U.S. Pat. No. 4,384,641 in that it includes a vertically extending front plate 36 formed with apertures 36*a*, 36*b* and 36*c* for receiving a custodian lock 38, a patron lock 40 and the forward end of a spring biased patron lock release rod 42, respectively; a coin insertion slot 36*d*, which is disposed for alignment with the upper end of a vertically extending, open ended coin chute 44 bounded in part by a vertically extending side plate 46 and a vertically extending inner guide plate 48, which are spaced apart to freely slidably engage with front and rear surfaces of coins deposited in the coin chute so as to cause such coins to pass on edge downwardly therethrough; and a closure plate 49. Separate means generally designated as 44*a* and 44*b* may be provided in association with coin insertion slot 36*d* for purposes of adjustably restricting the maximum size or diameter of coins, which may be inserted into the upper end of coin chute 44, and preventing insertion of a second coin, while a previously inserted coin is passing downwardly through the upper end of the coin chute. Front plate 36 may also be provided with additional apertures, not shown, to permit viewing of a counter mechanism and the return of coins, if required by the design/function of lock unit 10. Side plate 46 is provided with a slot 46*a*, which is sized to freely receive a lock bolt 50, slidably supported by a front plate mounted bracket 52 for movements between its retracted or unlocking and extended or locking positions shown in FIGS. 1 and 3, respectively. When lock unit 10 is mounted within mounting post 12 in the manner to be described, apertures 36*a*, 36*b* and 36*c* are disposed in alignment with apertures 18, 20 and 24, respectively; slots 36*d* and 46*a* are disposed for alignment with slots 22 and 30, respectively; and closure plate 49 is arranged rearwardly of flange portion 14*b* to bridge across mounting opening 32.

The construction of custodian and patron locks 38 and 40 is conventional from the standpoint that they generally include custodian and patron keys 38*a* and 40*a* removably insertable within tumbler supporting lock cylinders 38*b* and 40*b* through key insertion slots 38*b*′ and 40*b*′, with the cylinders in turn being supported for rotation within housings 38*c* and 40*c* under the control of keys 38*a* and 40*a*. Housings 38*c* and 40*c* extend rearwardly through front plate apertures 36*a* and 36*b*, are retained in assembled condition within such apertures by suitable spring clips 38*d* and 40*d* and serve to rotatably support generally cup-shaped barrels 38*e* and 40*e*, which barrels are keyed for rotation with rearwardly disposed ends of lock cylinders 38*b* and 40*b* freely extending through the rear walls of the housings. Custodian lock cylinder 38*b* and patron lock cylinder 40*b* are preferably removably retained within their respective housings and barrels in the manner to be described. Further, housings 38*c* and 40*c* are fixed against rotation relative to face plate 36, due to the non-round configuration of mounting apertures 36*a* and 36*b*, such that key controlled rotations of lock cylinders 38*b* and 40*b* relative to housings 38*c* and 40*c* impart corresponding rotations to barrels 38*e* and 40*e*, respectively.

Figure 4C:
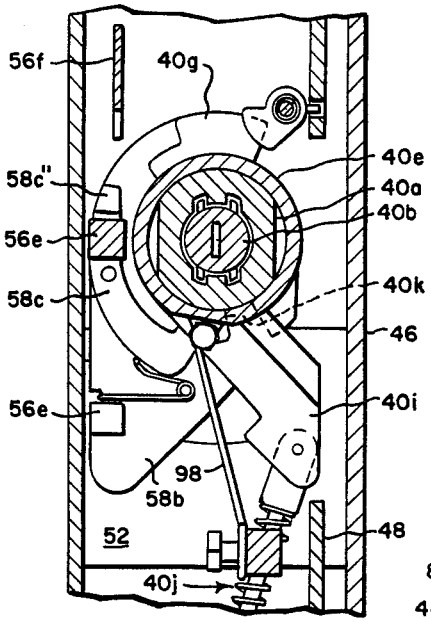
FIG. 4C is a sectional view similar to FIG. 4B, but showing the lock unit placed in unlocked condition by operation of the custodian lock.
Figure 6A:
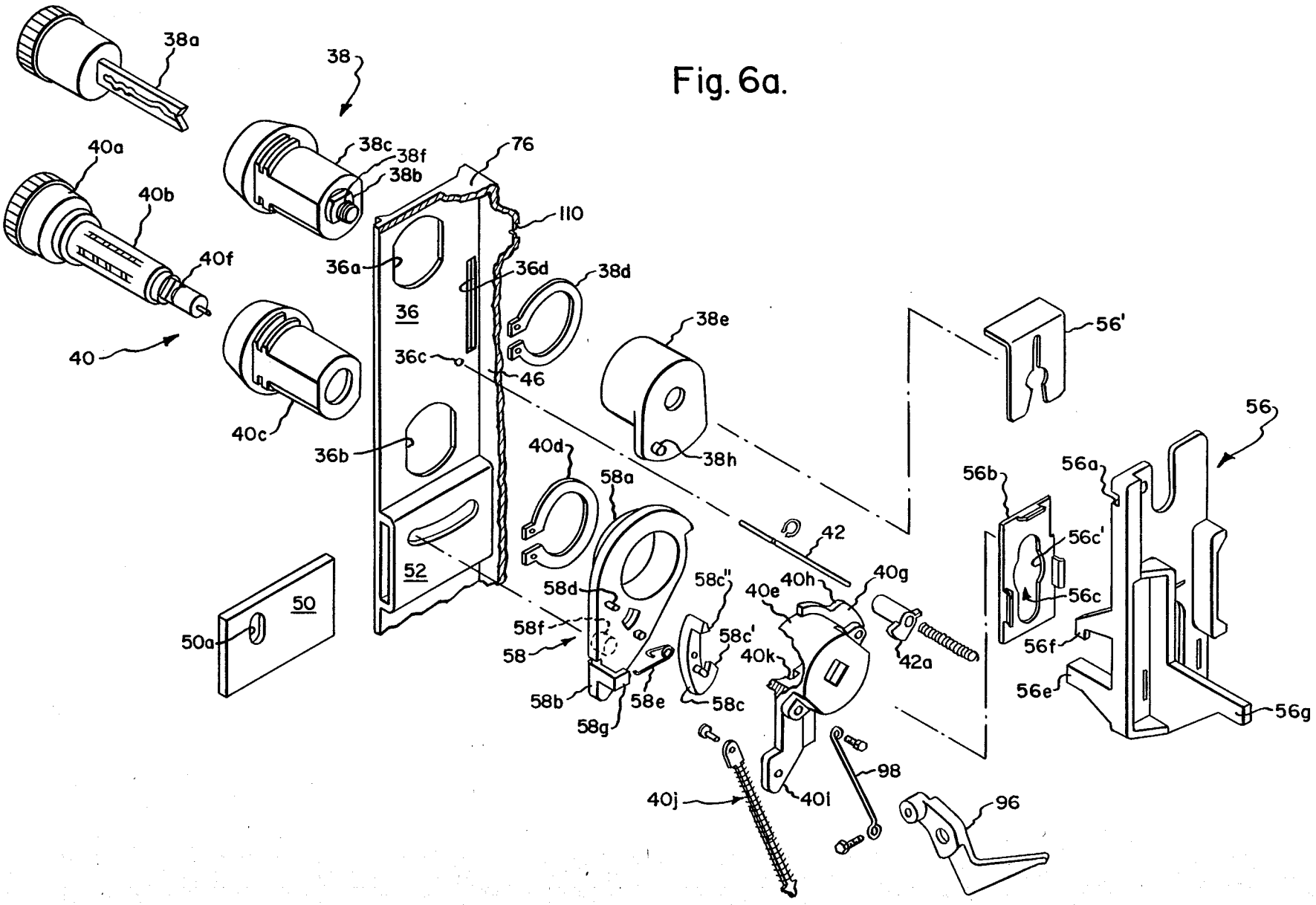
FIG. 6A is an exploded perspective view of the patron and custodian lock assemblies, the lock bolt and mechanism for operably coupling same.

Locks 38 and 40 additionally include suitable tumbler/slot mechanisms, shown partially only for the case of lock 40 in FIGS. 4A, 4C and 6A, which serve to constrain rotation of cylinders 38*b* and 40*b* relative to housings 38*c* and 40*c* when keys 38*a* and 40*a* are removed from such cylinders, as well as to prevent removal/insertion of the keys for all rotatable positions of the cylinders other than that in which their key insertion slots 38*b*′ and 40*b*′ are lengthwise bisected by a plane extending vertically through the locks. Thus, the custodian and patron locks as thus far described, are identical in construction, mode of operation and mode of mounting to that described in numerous prior patents, including U.S. Pat. Nos. 3,193,074 and 3,599,770 whose disclosures are incorporated by reference therein.

Custodian lock 38 and patron lock 40 are operably interconnected by a control bar 56, which is supported adjacent its upper end by a guide plate 56' for vertical sliding movements under the control of a custodian lock barrel mounted control pin **38*h* slidably received within control bar recess 56*a* between a normal lower or locking position and an upper or release position shown in full and broken line in FIG. 2, respectively. Control bar 56 may also be placed in an intermediate position, not shown, for purposes of permitting release of patron lock cylinder 40*b* for removal from within housing 40*c*. More specifically, patron lock cylinder 40*b* is normally releasably/operably connected to control bar 56 by providing the former with an annular groove 40*f* and the latter with a thin plate 56*b* formed with a slot 56*c*. Similarly, custodian lock cylinder 38*b* is releasably retained within housing 38*c* and barrel 38*e* by providing same with an annular groove 38*f* to snap fit receive guide plate 56'**.

The edges of plate **56*b* bounding slot 56*c* are slidably/guidably received within groove 40*f* for all positions of the control bar except for its intermediate postion, wherein a slot enlargement 56*c* is placed in alignment with lock cylinder 40*b*, such as to permit manual removal of the patron lock cylinder outwardly through the front end of housing 40*c* for purposes of repair and/or replacement. It will be noted that while the control bar of the present lock construction permits disassembly of patron lock 40 in a manner similar to that of control bars disclosed in U.S. Pat. Nos. 3,599,770 and 4,384,641, its structure and mode of operation is otherwise dissimilar. In this respect, present control bar 56 performs the additional functions of coupling custodian lock 38 to patron lock 40 in a manner permitting custodian controlled retraction and extension of lock bolt 50 for cabinet door unlocking/relocking purposes, while patron key 40*a* is in the possession of a patron, lost, damaged or otherwise unavailable for use in unlocking/relocking the patron lock and of coupling custodian lock 38 to a latch plate means 38*g*, which serves to removably retain lock unit 10 within mounting post 12. To perform these additional functions, present control bar 56 is formed with a forwardly projecting operating or first arm 56*e*; a forwardly projecting return or second arm 56*f*, which is arranged vertically above arm 56*e*; a rearwardly extending latch means operating or third arm 56*g***.

Figure 4B:
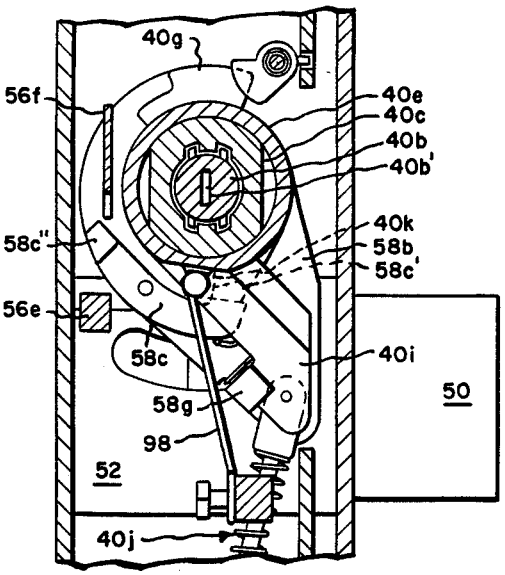
FIG. 4B is a view similar to FIG. 4A, but showing the lock unit in locked condition.

Again referring to FIGS. 2, 3 and 6, it will be understood that patron lock barrel **40*e* is conventional from the standpoint that it has a rim portion 40*g* formed with a recess 40*h* sized to removably receive an enlarged catch portion 42*a* carried by patron lock release rod 42 and a dependent arm 40*i* coupled to a conventional spring biased, overcenter device 40*j* adapted to alternatively bias the patron lock barrel to assume its normal or door unlocked and door locked postions best shown in FIGS. 4A and 4B, respectively. However, unlike prior lock mechanisms of the type described in the above referenced patents, patron lock barrel 40*e* is not directly connected to lock bolt 50, but rather is removably coupled thereto through a drive mechanism 58 normally operable to effect extension and retraction of the lock bolt incident to rotation of the patron lock barrel into and away from its door locked postion. Moreover, in the present construction, patron lock barrel 40*e* is not releasably constrained in its unlocked position by having its rim portion 40*g* provided with teeth, not shown, releasably engageable with a conventional pivotally supported coin feeler pawl, also not shown, of the type having a coin sensing finger arranged to project into coin chute 44, as in the case of U.S. Pat. Nos. 3,193,074 and 3,599,770, or into engagement with a coin gauging and counting mechanism, as in the case of U.S. Pat. No. 4,384,641. Rather, in the presently preferred construction, lock barrel arm 40*i* is adapted to directly cooperate with an improved coin gauging and counting mechanism 59 to be hereinafter described with particular reference to FIGS. 5 and 6B**.

Mechanism 58 is shown in FIGS. 2–4 and 6A as including a sleeve **58*a*, which is formed with an integral, dependent arm 58*b* and supported on housing 40*c* for rotation independently of barrel 40*e* between its normal or door unlocked and door locked positions shown in FIGS. 4A and 4B, respectively; and a latch arm 58*c*, which is pivotally mounted on arm 58*b* by a pivot pin 58*d* in association with an arm mounted spring 58*e*. Arm 58*b* is formed with a forwardly projecting pin 58*f*, which is sized to be rotatably and slidably received within a slot 50*a* formed in lock bolt 50, and a rearwardly projecting return flange 58*g* arranged for engagement with an edge of barrel arm 40*i*, which trails in the direction of movement of such arm towards the door locked position of barrel 40*e*. Latch arm 58*c* is formed with a latch end portion or tooth 58*c*, which is normally biased by spring 58*e* for engagement with a radially extending latch surface 40*k* defined by barrel 40*e* forwardly of its arm 40*i*; and an opposite transversely enlarged operating end portion 58*c*'' adapted to be selectively engaged by operating and return arms 56*e* and 56*f* of control bar 56** in the manner to be described.

By again referring to FIGS. 4A and 4B, it will be understood that, during normal operation of lock unit 10, engagement of latch tooth **58*c* with latch surface 40*k* serves to operably couple sleeve 58*a* to barrel 40*e*, when the latter is rotated under control of patron key 40*a* in a counterclockwise direction for purposes of moving lock bolt 50 from its retracted or door unlocked position shown in FIG. 4A into its extended or door locked position shown in FIG. 4B, whereas engagement of barrel arm 40*i* with return flange 58*g* serves to operably couple sleeve 58*a* to lock barrel 40*e*, when the latter is rotated under the control of the patron key in a clockwise direction for purposes of returning the lock bolt to its initial retracted position. It will also be noted that during normal operation of lock unit 10, custodian lock 38 is in its normal locked condition, such that control bar 56 is maintained in its normal or lower position illustrated in full line in FIGS. 2 and 3, wherein its operating and return arms 56*e* and 56*f* are removed from alignment with the path of travel of latch arm end portion 58*c*'' incident to patron lock barrel induced rotations of sleeve 58*a* for purposes of extending and retracting lock bolt 50. However, after lock barrel 40*e* has been moved into its locked position by patron key 40*a* and the patron key removed from patron lock 40, latch arm 58*c* may be operated under custodian control to effect rotation of sleeve 58*a* between its locked and unlocked positions, and thus movement of bolt 50 between its extended and retracted positions, independently of barrel 40*e*. More specifically, when sleeve 58*a* is arranged in its door locked position and control bar 56 disposed in its normal lower position, control bar arm 56*e* is disposed immediately below latch arm end portion 58*c*'', as best shown in FIG. 4B. Thus, when a custodian desires to obtain access to a locked storage compartment, he merely employs key 38*a* to unlock custodian lock 38 with the result that control bar 56 is lifted thereby into its upper broken line position shown in FIG. 2. As an incident to upward movement of control bar 56, arm 56***e* is lifted into underlying engagement with latch arm end portion 58*c*'', whereafter latch arm tooth 58*c*' is first pivotally displaced from engagement with patron lock barrel latch surface 40*k* against the bias of spring 58*e* and sleeve 58*a* then driven through latch arm 58*c* for return to its door unlocked postion for purposes of returning lock bolt 50 to its retracted position, shown in FIG. 4C. The custodian may thereafter return lock bolt 50 to its extended position by employing key 38*a* to relock custodian lock with the result that control bar 56 is lowered or returned to its initial lower or full line position shown in FIG. 2. As an incident to downward movement of control bar 56, arm 56*f* is forced downwardly into overlying engagement with latch arm end portion 58*c*'', whereupon sleeve 58*a* is driven through latch arm 58*c* in a counterclockwise direction, as viewed in FIG. 4C, sufficiently to return lock bolt 50 to its extended or locked position and to return latch arm tooth 58*c*' to a position in alignment with patron lock barrel latch surface 40*k*, whereupon spring 58*e* is free to pivot the latch arm about the axis of pivot pin 58*d* for purposes of reengaging the latch arm tooth with the latch surface, as viewed in FIG. 4B.

As previously indicated, control bar 56 may also be manipulated under the control of custodian lock 38 for purposes of controlling operation of latch plate means 38*g*, which serves to releasably retain lock unit 10 within mounting post 12. Latch plate means 38*g* is best shown in FIG. 12 as comprising a lower latch plate 60 formed with vertically spaced drive ribs 60*a* and 60*b*; an upper latch plate 62; a guide block 64 formed integrally with closure plate 49; and a coupling wheel 66 rotatably supported on guide block 64 by a fastener 68. The remote or respective lower and upper ends of latch plates 60 and 62 are slidably supported within guide slots 70 and 72 formed in upper and lower plates 74 and 76, which are in turn marginally suitably edge joined to front plate 36, side plate 46 and closure plate 49 to complete a box-like casing for lock unit 10 having a single open side closable by a suitably secured opposite side or cover plate 78, such as by threaded fasteners extending through the upper and lower plates into mounting flanges, not shown, formed integrally with such opposite side plate. The adjacent or respective upper and lower ends of latch plates 60 and 62 are cut away to define facing guide edges 60*c* and 62*c* arranged for free sliding engagement with opposite, vertically extending side surfaces of guide block 64 and facing stop edges 60*d* and 62*d* arranged for removable engagement with the lower and upper surfaces of such guide block for purposes of limiting the degree of converging travel of the latch plates. Latch plates 60 and 62 are coupled to one another for oppositely directed extending and retracting movements between their latched and unlatched positions shown in full and broken line in FIG. 12, respectively, by having their adjacent ends coupled to wheel 66 by wheel carried drive pins 66*a* freely and rotatably received within plate apertures, not shown.

By referring to FIGS. 2 and 12, it will be understood that latch plates 60 and 62 may be moved between their normal latched and their unlatched positions as an incident to custodian controlled operation of custodian lock 38 for purposes of moving control bar 56 into its upper broken line position shown in FIG. 2. As an incident to upwardly directed movement of control bar 56, its arm 56*g* is brought into underlying engagement with upper drive rib 60*a* of lower plate 62 and thereafter moves such drive rib upwardly until the lower end of latch plate 60 is disposed flush with the lower surface of lower plate 74; wheel 66 coupling upper latch plate 62 to lower plate 60 such that the upper end of latch plate 62 is simultaneously moved to lie flush with the upper surface of upper plate 76. Upon return of control bar 56 to its normal lower position shown in full line in FIG. 2, arm 56*g* is lowered into engagement with drive rib 60*b* for purposes of returning the latch plates to their normal extended or latching position.

Figure 5A:
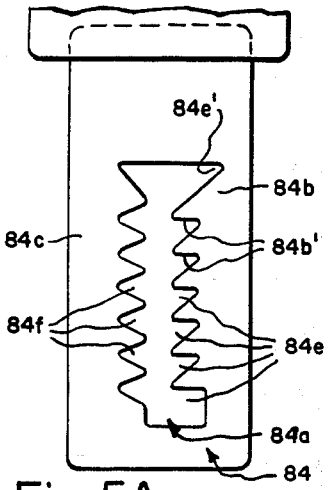
FIG. 5A is an enlarged elevational view of a control plate forming a part of the mechanism of FIG. 5.
Figure 5:
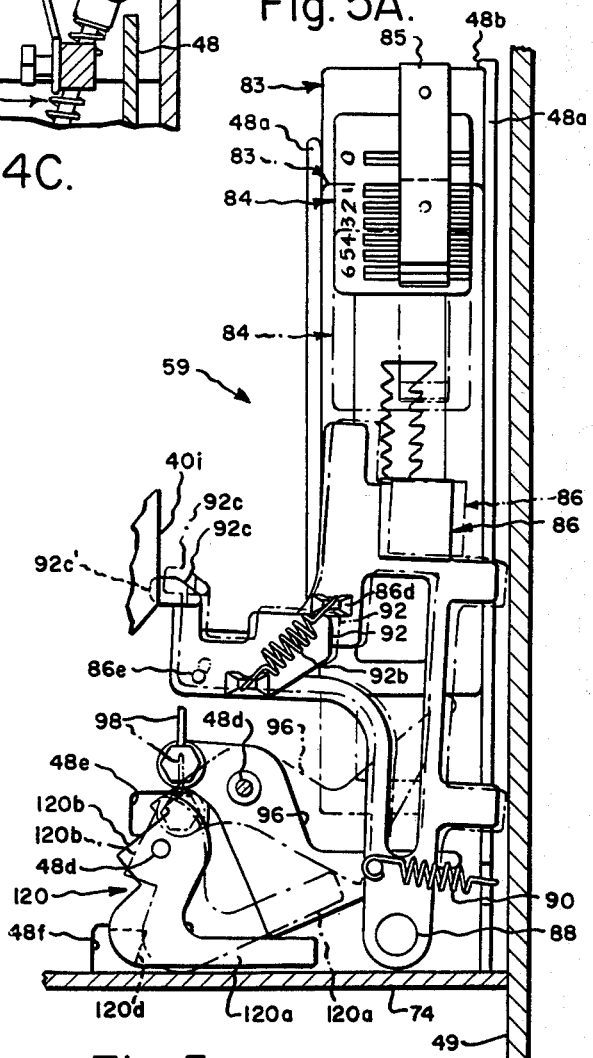
FIG. 5 is a side elevational view of the coin gauging and counting mechanism.

In accordance with a preferred form of the present invention, lock barrel 40*e* is releasably constrained from rotation from its door unlocked position for door locking purposes until a desired number of properly sized coins are deposited in coin chute 44 by coin gauging and counting mechanism 59 arranged to operably engage with its arm 40*i*. Mechanism 59 is best shown in FIG. 6B as generally including an adjustable coin counting means 80 and a coin gauging means 81. Counting means 80 preferably comprises a vertically elongated slide plate 83, which is best shown in FIG. 5 as being supported adjacent inner guide plate 48 by guide plate mounted guide ribs 48*a* for vertically directed sliding or reciprocating movements from and for return to an initial upper or first position shown in FIG. 2 and in full line in FIG. 5 defined by engagement of the upper end of the slide plate with a guide plate mounted stop 48*b*; a control or ratchet plate 84, which is slidably supported within slide plate slot opening 83*a* and formed in turn with a slot opening 84*a* bounded on each side thereof by columns of facing ratchet teeth 84*b* and 84*c*; and a latch device in the form of a slide plate mounted spring clip 85 having its lower or latch end 85*a* releasably received within one of a plurality of parallel coin number control recesses 84*d* arranged to extend transversely of the upper end of control plate 84. Ratchet teeth 84*b* and 84*c* serve to define a plurality of essentially uniformly spaced counting recesses 84*e* and stepping recesses 84*f*, respectively, which are vertically offset such that recesses 84*f* are disposed in essential alignment with the apexes of ratchet teeth 84*b*, as best shown in FIG. 5A. Moroever, it will be noted that recesses 84*e* are characterized as having an essentially uniform or equal depth, as measured transversely of control plate 84, with the exception of the uppermost or release recess 84*e*', which trails with respect to the direction of movement of plates 83 and 84 away from their first positions, whose depth is noticeably larger. It will be further noted that the lower boundary edges 84*b*' of ratchet teeth 84*b* extend transversely of control plate 84 in a parallel relationship with a spacing therebetween corresponding essentially to the spacing between the parallel recesses 84*d* provided adjacent the upper end of the control plate.

Coin gauging means 81 includes a coin gauging pawl 86, which is pivotally supported adjacent its lower end by an inner guide plate mounted pin 88 for pivotal movements from its normal gauging position shown in full line in FIG. 5 in opposite directions into coin release position to be described with reference to FIG. 9 and lock release position shown in broken line in FIG. 5; pawl 86 being normally biased towards its lock release position by suitable means such as a coil spring 90. The upper end of pawl 86 carries a plate 91 having a tab or ratchet element 91*a*, which is sized for receipt alternately within recesses 84*e*, 84*f* and 84*e*'. Pawl 86 includes a forwardly projecting arm portion 86*a* having a first transverse enlargement 86*b*, which projects transversely thereof into the confines of coin chute 44 through an aperture 48*c* formed in inner guide plate 48 and defines a gauging surface 86*c*; and a second, oppositely extending enlargement or stop 86*d*. Arm enlargement 86*b* additionally carries a pivot pin 86*e* for purposes of mounting a release lever 92 having a first end 92*a* normally biased by a coil spring 92*b* into a latching position wherein it is disposed in underlying engagement with second enlargement 86*d*; an opposite or latching end 92*c* arranged for removable engagement with barrel arm 40*i*; and an intermediate enlargement 92*d*, which cooperates with enlargement 86*d* to mount the ends of spring 92*b*.

When gauging surface 86*c* is disposed in its normal gauging position, best shown in full line in FIG. 9, which corresponds to the normal gauging position of pawl 86 and is defined by receipt of tab 91*a* within any one of recesses 84*e*, the spacing between the gauging surface and the rear edge or guide surface 44*c* of coin chute 44, such as may be defined by coin size selector plate or member 94 to be hereinafter described, is characterized as being less than a given diameter of a given denomination coin of a given currency intended to operate the lock unit, e.g., a U.S. 25 cent coin, but greater than the diameters of other coins of such currency of small denomination, e.g., U.S. 1, 5 and 10 cent coins. The front edge of coin chute 44, which is spaced from rear guide surface 44*c* sufficiently to allow coins of the given diameter to freely pass downwardly through the coin chute, may be suitably defined, such as by guide lugs or flanges 46*b* projecting inwardly from the inner surface of side plate 46.

In a coin release position of gauging surface 86*c*, which is shown in broken line in FIG. 9 and corresponds to the coin release position of pawl 86 defined by receipt of tab 91*a* within any one of recesses 84*f*, the gauging surface is spaced from rear guide surface 44*c* through a distance slightly greater than the given coin diameter, so as to permit unobstructed passage of coins of such given diameter downwardly through coin chute 44. As will be apparent from viewing FIG. 9, end 92*c* of release lever 92 is disposed in alignment with patron lock barrel arm 40*i* for both the above described coin gauging and release positions of gauging surface 86*c*, so as to constrain rotation of patron lock 40 towards its locked condition; any pressure applied to end 92*c* by an attempt to so rotate the patron lock being transmitted thereby to the inner surface of side plate 46, which has sufficent strength to withstand such pressure.

In the above mentioned lock release position of pawl 86, which is defined by receipt of tab 91*a* within uppermost recess 84*c*′ under the bias of spring 90, release lever end 92*c* assumes its lock release position, wherein it is removed from alignment with patron lock barrel arm 40*i*, as shown in broken line in FIG. 5, whereby to permit rotation of the patron lock towards its locked position.

Operation of mechanism 59 will now be described by first assuming that a custodian has previously moved control plate 84 upwardly within slide plate opening 83*a* sufficiently to arrange the lowermost one of recesses 84*d*, e.g., that designated as "6" in FIGS. 5 and 6B, to receive spring clip latch end 85*a* and thereby provide lock unit 10 with a six coin operating capacity; and that slide plate 83 and thus mechanism 59 is in its initial or first position shown in full line in FIGS. 2 and 5, wherein tab 91*a* is biased for receipt within the lowermost one of ratchet teeth recesses 84*e* by spring 90 to thereby arrange gauging surface 86*c* in its gauging position. When a patron desires to operate lock unit 10, he would successively insert into coin chute 44, six coins of a given denomination, such as U.S. quarters, pursuant to instructions placed on the front of locker L. As the first quarter passes downwardly through the coin chute, it is constrained to pass between gauging surface 86*c* and rear guide surface 44*c*, with the result that the weight of the quarter acting on the gauging surface will force same to move against the bias of spring 90 into its coin release position, wherein tab 91*a* is forced into the lowermost one of ratchet teeth recesses 84*f* to initiate downward movement of slide plate 83. Upon movement of the first quarter downwardly past gauging surface 86*c*, spring 90 is free to return the gauging surface to its gauging position, whereupon tab 91*a* is forced to move to the right, as viewed in FIG. 5, and due to the vertically offset relationship of recesses 84*f* and 84*e*, enter the second of recesses 84*e* to complete one coin counting cycle, incident to which slide plate 83 is caused to again move downwardly; the total movement of the slide plate occasioned by the travel of tab 91*a* between adjacent recesses 84*e* comprising one unit of travel from its initial position.

For each quarter subsequently deposited in coin chute 44, the above described coin counting cycle will be repeated with slide plate 83 being moved downwardly in a stepwise manner. As an incident to the depositing of the last or sixth quarter in coin chute 44, mechanism 59 assumes its lock release condition, wherein tab 91*a* is forced to move into the last or uppermost of the six recesses 84*c*′ to complete the coin counting operation coincident to which release lever end 92*c* is removed from alignment with patron lock barrel arm 40*i* to free patron lock 40 for movement into its locked position. It will be understood that the introduction of coins having a diameter less than the given diameter of a U.S. quarter has no effect on the operation of lock unit 10, since same freely pass downwardly between gauging surface 86*c* and the rear edge 44*c* of coin chute 44 without requiring movement of the gauging surface from its normal gauging position. Preferably, coin chute 44 is slightly inclined forwardly relative to vertical, as best shown in FIG. 9, so that coins of all diameters tend to roll downwardly along rear edge 44*c* and thus coins smaller in diameter than a U.S. quarter are maintained in a spaced relationship relative to gauging surface 86*c* to prevent accidental engagement therebetween with sufficient force to move pawl 86 from its gauging position.

As an incident to movement of patron lock 40 into its locked position, a return lever 96, which is supported on a bearing pin 48*d* projecting from the inner surface of guide plate 48 and coupled to patron lock barrel 40*e* by a suitable push-pull linkage 98, is caused to undergo pivotal movement between its normal and return positions shown in full line and broken line in FIG. 5, respectively. Movement of lever 96 into its return position serves to drive or lift slide plate 83 for return to its initial upper position to prepare mechanism 59 for a subsequent coin counting operation; spring 90 permitting ratcheting movements of tab 91*a* relative to teeth 84*b* until such tab is returned for receipt within the lowermost one of recesses 84*e*. Return of patron lock 40 to its unlocked condition serves to pivot lever 96 for return to its normal position and free mechanism 59 for subsequent operation.

It will be understood that the edge of patron lock barrel arm 40*i*, which leads in the direction of rotation of patron lock 40 towards its locked position, moves operably past lever 92, that is, moves along the forwardly facing surface 92*c'* of latch end 92*c*, before movement of patron lock 40 towards its locking position has progressed sufficiently to move return lever 96 into its return position, whereby surface 92*c'* is arranged for engagement with the rearwardly facing surface of arm 40*i* for essentially all rotatable positions of the patron lock other than at and immediately adjacent its unlocked position. Thus, it will be noted that the pivotal mounting of lever 92 on pawl 86 in association with spring 92*b* provides for relative movements between such lever and pawl as required to permit ratcheting movements of tab 91*a* relative to teeth 84*b* during return of slide plate 83 to its initial upper position.

Mechanism 59 may be adjusted to accommodate lock unit 10 for operation by a smaller number of coins by the simple expedient of removing spring clip latch end 85*a* from engagement within the lowermost of recesses 84*d*, such as that designated as "6", and then sliding control plate 84 downwardly within slot opening 83*a* until latch end 85*a* is aligned with a desired one of other recess 84*d*, such as that designated as "4" to provide the lock unit with a four coin operating capacity. Operation of mechanism 59 adjusted in this manner is identical to that described above with the exception that tab 91*a* is initially arranged for receipt within the third one of recesses 84*e*, as measured from the bottom of slot opening 84*a*.

In the presently preferred construction, adjustment of mechanism 59 may be effected by a custodian without requiring removal of side plate 78 to gain access thereto. This may be accomplished by providing side plate 78 with a recessed area 100 through which extend apertures 100*a*–100*c*, which when slide plate 83 is in its upper position, are aligned, respectively, with spring clip latch end 85*a* and adjacent ones of recesses 84*d*; the numeral associated with that one of recesses 84*d* with which latch end 85*a* is engaged; and ratchet teeth 84*e* and a release tab 86*f* formed integrally with pawl 86. If for instance a custodian wishes to change mechanism 59 to provide for four coins, as opposed to the illustrated six coin operation, he would use two pointed instruments, such as pencils, to first move release tab 86*f* to the left, as viewed in FIG. 8, sufficiently to remove tab 91*a* from underlying engagement with the lower edge 84*b'* of the lowermost of teeth 84*b* in order to free slide plate 83 and control plate 84 for downwardly directed movement, and to then move the slide and control plates downwardly until a desired numeral, such as "4", is aligned with aperture 100*b*. Adjustment of mechanism 59 is completed by first constraining control plate 84 against movement, as by engaging teeth 84*c*, and then slightly lifting latch end 85*a* towards side plate 78, while pushing same vertically upwardly thereby to cause slide plate 83 to return to its initial upper position, as latch end 85*a* ratchets relative to recesses 84*d*. Mechanism 59 may be subsequently adjusted for return to a six coin operating condition, while slide plate 83 is in its initial upper position, by simply applying upwardly directed pressure on control plate 84, as by engaging teeth 84*c* or recesses 84*d*, until the "6" recess of recesses 84*d* is again aligned with latch end 85*a*; latch end 85*a* and tab 91*a* ratcheting relative to recesses 84*d* and teeth 84*b*, respectively, as control 84 slides upwardly relative to slide plate 83.

Now referring to FIGS. 1, 9 and 10, it will be understood that the means 44*a* for restricting the size of coins, which may be inserted through slot 36*d*, departs from prior constructions of the type disclosed for instance in U.S. Pat. No. 3,228,506 in that it comprises a lever 102, which has its rear or remote end apertured to rotatably receive a slide plate mounted pin or projection 104 and its front or adjacent end formed with at least one and preferably several apertures 106 threaded to removably receive a fastener device 108 selectively, removably positioned to extend through one of a plurality of stepped diameter apertures 110 formed in side plate 46 and then into one or the other of apertures 106. By selecting the proper number and arrangement of apertures 106 and 110, lever 102 may be adjusted by having its front end moved or swung vertically of slot 36*d* in order to vary the effective size thereof and thus accommodate lock unit 10 for use with a desired number of coin denominations of different currencies. Another decided advantage of this arrangement is that adjustment of lever 102 may be effected by a custodian without first gaining access to the interior of the lock unit casing.

Reference is now made to FIGS. 1 and 9–11, wherein is depicted a novel arrangement for permitting a custodian to selectively vary the size of coin chute 44 without the necessity of first gaining access to the interior of the lock unit casing. Specifically, this arrangement includes coin size selector plate 94, which has a planar front surface 94*a* serving to define coin chute rear edge 44*c*; and a plurality of essentially parallel coin size selector slots 112, which open downwardly through an access slot or opening 74*a* provided in lower casing wall 74 and are sized to removably, slidably receive a mounting rib 94*b* extending lengthwise of the selector plate adjacent its front surface 94*a*. Preferably, access slot 74*a* is forwardly extended to define a coin discharge opening communicating with the lower end of coin chute 44, as best shown in FIG. 9. Slots 112 may be formed on the inner surface of side plate 46, which may also be provided with a horizontally extending, shallow locking slot 114 sized and shaped to releasably receive a locking detent or rib 94*c* provided adjacent the lower end of selector plate 94 rearwardly of its front surface 94*a*. The lower end of selector plate 94 is additionally provided with a forwardly opening operating notch 94*d*, which is accessible through access slot 74*a* for receipt of a pointed instrument, such as a pencil. If desired, loer plate 74 may be provided with suitable markings for purposes of visually identifying the coin size limits established by slots 112, that is, appraising a custodian of the size of coin chute 44, which will be established upon mounting selector plate 94 within each of such slots. In the illustrated construction, the markings and slot arrangement are intended for use in accommodating the lock unit for U.S. and West German currencies.

In the illustrated arrangement, coin selector plate 94 is positioned in the third of slots 112, as measured from the front end of access slot 74*a*, so as to arrange its front surface 94*a* relative to gauging surface 86*c* as required to accommodate lock unit 10 for operation of U.S. quarters. If it is desired to convert lock unit 10 for operation by a differently sized coin, such as for instance, a Susan B. Anthony dollar, a custodian would simply insert a pointed instrument into notch 94*d* and pull selector plate 94 from within the third slot 112 outwardly through access slot 74*a*; locking detect 94*c* and/or side plate 46 undergoing a sufficient degree of resilient deformation to permit forced removal of the locking detent from within locking slot 114. Selector plate 94 would then be inserted into the fourth of slots 112, as measured from the front of access slot 74*a*, until releasably locked in its new adjusted position incident to the snap-fitting of locking detent 94*c* within locking slot 114. Removably snap-fitting of locking detent 94*c* and locking slot 114 is facilitated by forming both selector plate 94 and side plate 46 of suitable plastic material, and by extending access slot 74*a* substantially beyond the area of the lower ends of slots 112, as shown in FIG. 9, such that flexure of side plate 46 is not constrained by lower plate 74 in this area. While only six coin size selector slots are shown, this number is not limiting on the number of possible adjustments in the size of coin chute 44, since if desired, each slot may be used for multiple adjustments by simply providing additional coin selector plates, not shown, which differ one from another only in the positioning of their mounting ribs relative to their planar front surfaces. Also, it will be appreciated that if a lock unit is intended for use with only one currency, then only a single locking slot need be provided in combination with a group of appropriately sized selector plates.

Lock unit 10 may also be provided with a coin return lever 120, adapted to selectively accommodate the lock unit for "free" single coin operation, when mechanism 59 is adjusted to engage latch end 85*a* within the recess 84*d* designated as "1". Coin return lever 120, which may be removably fitted on inner guide plate mounted bearing pin 48*d*, is of generally L-shaped configuration including a first or lower leg portion 120*a* having its free end arranged for engagement with the lower end of return lever 96 and a second or upper leg portion 120*b* having its free end arranged to engage with the upper end of such return lever. Coin return lever 120 is provided within an upper or first coin arresting lug 120*c*, which projects transversely of the free end of second leg portion 120*b* freely through an inner guide plate opening 48*e* and a lower or second coin arresting lug 120*d*, which projects transversely of the joined end of the second leg portion freely through inner guide plate opening 48*f*. By viewing FIGS. 2 and 9, it will be understood that when lock unit 10 is adjusted to provide for "free" single coin operation, coin return lever 120 resides in a first or coin arresting/release position shown in full line in FIGS. 1, 5 and 9, when return lever 96 occupies its normal position corresponding to the unlocked condition or position of patron lock 40. In this coin arresting/release position, which is defined by underengagement of first leg portion 120*a* with return lever 96, upper lug 120*c* is disposed in a coin arresting position within coin chute 44 in order to cooperate with rear edge portioon 44*c* for interrupting passage of a coin of a given diameter, such as a U.S. quarter, while permitting smaller coins to pass freely for return to a patron via a coin discharge chute, not shown, joined to the lower end of the coin chute. Upon depositing of a coin of given diameter, mechanism 59 functions in the manner described above to displace slide plate 83 through one step of movement coincident to which tab 91*a* is positioned in uppermost or release recess 83*e*′ to free patron lock 40 for movement into its locked position. As return lever 96 is pivoted into its broken line position shown in FIG. 5 by locking movement of patron lock 40 for purposes of returning slide plate 83 to its initial position, the lower portion of return lever 96 rides off of the free end of first leg portion 120*a*, as the upper portion of return lever 96 moves into engagement with the free end of second leg portion 120*b*. As a result, coin return lever 120 is driven in a counterclockwise direction by lever 96 until it assumes its second or coin arresting portion shown in broken line in FIG. 5 corresponding to the locked position of patron lock 40, wherein first lug 120*c* is retracted from its coin arresting position within coin chute 44 to release the previously arrested coin and second lug 120*d* is moved into the coin chute into its coin arresting position to again arrest passage of such coin, but at a lower level; the lugs assuming the positions shown in broken line in FIG. 9.

When patron lock 40 is subsequently returned to its unlocked condition and return lever 96 returned as a result thereof to its initial position, the lower end of lever 96 drivingly engages first leg portion 120*a* for purposes of moving lever 120 in a clockwise direction until it assumes its normal position shown in full line in FIG. 5. As a result of this movement, second lug 120*d* is retracted from its arresting position within the coin chute to permit discharge of the previously arrested coin therefrom for return to the patron, as first lug 120*c* is returned to its initial coin arresting position.

While lock unit 10 may be operated on a "free" status without fitting the lock unit with coin return lever 120 by simply placing latch end 85*c* in the uppermost of recesses 84*d* coincident to which tab 91*a* would be received within recess 84*e*′, the utilization of such lever is desirable since retention of a patron's coin within the lock unit until after patron key 40*a* has been employed to return the patron lock to unlocked condition provides an incentive for the proper return of the patron key.

The above described lock unit 10, while unique in its construction and capabilities, additionally possesses the advantage that it admits to the use of molded plastic materials in forming essentially all portions thereof excepting primarily those elements exposed to view outwardly of its mounting post, springs and minor connectors whose thickness or size does not readily admit to use of plastic materials.

While a preferred form of lock unit 10 has been described in detail incorporating a plurality of novel features, persons skilled in the art will understand that such features are readily adapted for independent use in other lock units.

What is claimed is:

1. A coin operated lock unit comprising in combination:

a patron controlled lock;

a custodian controlled lock;

a coin chute;

means responsive to insertion of at least one coin of a given denomination into said coin chute for freeing said patron lock for movement from an unlocked position into a locked position thereof;

a lock bolt movable between unlocked and locked positions;

drive means for normally coupling said lock bolt to said patron lock for effecting movements of said lock bolt back and forth between said unlocked and locked positions thereof coincident with movements of said patron lock back and forth between said unlocked and locked positions thereof; and drive means control means under the control of said custodian lock for uncoupling said lock bolt from said patron lock and effecting movements of said lock bolt back and forth between said locked and unlocked positions thereof, while said patron lock is in said locked position thereof.

2. A coin operated lock unit according to claim 1, wherein said patron lock includes a patron lock barrel supported by said patron lock for rotation between unlocked and locked positions corresponding to said unlocked and locked positions of said patron lock, said barrel having a latch surface and an arm; and said drive means includes a sleeve supported by said patron lock for rotation independently of said barrel and having a drive connection with said lock bolt, a latch arm supported for pivotal movement relative to said sleeve and normally biased into engagement with said latch surface for releasably drivingly coupling said sleeve for rotational movement with said barrel as same rotates towards said locked position thereof for moving said lock bolt into said locked position thereof and return means carried by said sleeve and arranged for engagement by said arm for releasably drivingly coupling said sleeve for rotational movement with said barrel as same rotates towards said unlocked position thereof for effecting movement of said lock bolt into said unlocked position thereof, and said control means is removably drivingly coupled to said latch arm for removing same from engagement with said latch surface and thereafter effecting rotational movements of said sleeve back and forth between said locked and unlocked positions thereof independently of said barrel.

3. A coin operated lock unit according to claim 2, wherein said means responsible to insertion of at least one coin includes a member positioned for engagement by said arm of said lock barrel to prevent rotation of said barrel into said locked position thereof until insertion of at least said one coin of said given diameter into said coin chute.

4. A coin operated lock unit according to claim 3, wherein said means responsible to insertion of at least one coin is adjustable to accommodate said lock unit for operation by more than one coin of said given diameter.

5. A coin operated lock unit according to claim 4, wherein said coin chute is adjustable to selectively vary said given diameter of coin intended to operate said lock unit.

6. A coin operated lock unit according to claim 2, wherein said control means includes a plate mounted for sliding movement under the control of said custodian lock between first and second positions, said plate mounting first and second arms spaced apart in alignment with the direction of said sliding movements, said arms are spaced from said latch arm when said plate is in said first position, and said first and second arms are alternatively drivingly coupled to said latch arm incident to said sliding movement of said plate from and for return to said first position.

7. A coin operated lock unit according to claim 6, wherein said lock unit additionally includes latch means for releasably retaining said lock unit mounted within a locker cabinet and said plate is drivingly coupled to said latch means for moving same between latched and unlatched positions thereof incident to movement of said plate between said first and second positions thereof.

8. A coin operated lock unit according to claim 1, wherein said means responsive to insertion of at least one coin includes a coin gauging means projecting into said coin chute and movable only in response to the passage of a coin of said given diameter downwardly therethrough and a coin counting means movable incident to said movement of said gauging means for counting the number of coins of said given diameter passing downwardly through said coin chute, said gauging means being normally disposed for blocking engagement with said patron lock to prevent movement into said locked position thereof, and said counting means permits movement of said gauging means from blocking engagement with said patron lock only upon counting of a preselected number of coins of said given diameter.

9. A coin operated lock unit according to claim 2, wherein said coin chute has opposite side wall portions and opposite edge portions cooperating to constrain coins to pass downwardly on edge therethrough; and said means responsive to insertion of at least one coin includes a coin counting means and a coin gauging means, said gauging means having a gauging surface projecting into said coin chute and supported for movement from a coin gauging position in opposite directions into coin release and lock release positions, a bias tending to move said gauging surface in a direction towards said lock release position, said gauging surface is constrained by said counting means from movement beyond said coin gauging position towards said lock release position until a preselected number of coins of said given diameter have passed through said coin chute, said gauging surface when in said coin gauging position being spaced from one of said edge portions of said coin chute through a distance less than said given diameter, but greater than the diameter of smaller denomination coins of a like currency intended for use in operating said lock unit, said gauging surface when engaged by a coin of said given diameter passing between said gauging surface and said one of said edge portions being temporarily removable thereby against said bias from said coin gauging position into said coin release position, wherein it is spaced from said one of said edge portions through a distance equal to or greater than said given diameter thereby to permit continued passage of the coin of said given diameter downwardly through said chute and subsequent return movement of said gauging surface towards said coin gauging position under said bias, each movement of said gauging surface from said coin gauging position into said coin release position and return movement thereof to said coin gauging position or through said coin gauging position into said lock release position comprising a single coin counting cycle incident to which said coin counting means moves under the control of said coin gauging means, movements of said coin counting means corresponding in number to said preselected number of coins permitting movement of said gauging surface into said lock release position, and said coin gauging means is arranged in blocking engagement with said arm of said patron lock to prevent movement of said patron lock into said locked position thereof for all positions of said gauging surface excepting said lock release position.

10. A coin operated lock according to claim 9, wherein said one of said edge portions is defined by a member adjustably carried by said lock unit for selectively varying the distance between said one of said edge portions and said gauging surface when in said gauging position thereof for selectively varying said given diameter of coins adapted to operate said lock unit.

11. A coin operated lock unit comprising in combination:

a patron controlled lock movable between unlocked and locked positions;

a coin chute;

a lock bolt coupled to said patron lock for movement between unlocked and locked positions coincident to movement of said patron lock between said unlocked and locked positions thereof; and means responsive to insertion of a preselected number of coins of a given diameter within said coin chute for freeing said patron lock for movement between unlocked and locked positions thereof, said means including a coin gauging means projecting into said coin chute and movable only in response to the passage of a coin of said given diameter downwardly therethrough and a coin counting means movable incident to said movement of said gauging means for counting the number of coins of said given diameter passing downwardly through said coin chute, said gauging means being normally disposed for blocking engagement with said patron lock to prevent movement into said locked position thereof, and said counting means permitting movement of said gauging means from blocking engagement with said patron lock only upon counting of said preselected number of coins of said given diameter.

12. A coin operated lock unit according to claim 11, wherein said coin counting means is adjustable to vary the number of movements thereof required to permit movement of said gauging means from blocking engagement with said patron lock.

13. A coin operated lock unit comprising in combination:

a patron controlled lock movable between unlocked and locked positions;

a coin chute having opposite side wall portions and opposite edge portions cooperating to constrain coins to pass downwardly on edge therethrough;

a lock bolt coupled to said patron lock for movement between unlocked and locked positions coincident to movement of said patron lock between said unlocked and locked positions thereof; and means responsive to insertion of a preselected number of coins of a given diameter within said coin chute for freeing said patron lock for movement between said unlocked and locked positions, said means including a coin counting means and a coin gauging means, said gauging means having a gauging surface projecting into said coin chute and supported for movement from a coin gauging position in opposite directions into coin release and lock release positions, a bias tending to move said gauging surface in a direction towards said lock release position, said gauging surface is constrained by said counting means from movement beyond said coin gauging position towards said lock release position until said preselected number of coins of said given diameter have passed through said coin chute, said gauging surface when in said coin gauging position is spaced from one of said edge portions of said coin chute through a distance less than said given diameter, but greater than the diameter of smaller denomination coins of a like currency intended for use in operating said lock unit, said gauging surface when engaged by a coin of said given diameter passing between said gauging surface and said one of said edge portions being temporarily movable thereby against said bias from said coin gauging position into said coin release position, wherein it is spaced from said one of said edge portions through a distance equal to or greater than said given diameter thereby to permit continued passage of the coin of said given diameter downwardly through said chute and subsequent return movement of said gauging surface towards said coin gauging position under said bias, each movement of said gauging surface from said coin gauging position into said coin release position and return movement thereof to said coin gauging position or through said coin gauging position into said lock release position comprising a single coin counting cycle incident to which said coin counting means moves under the control of said coin engaging means, movements of said counting means corresponding in number to said preselected number of coins permitting movement of said gauging surface into said lock release position, and said coin gauging means is arranged in blocking engagement with said patron lock to prevent movement into said locked position thereof for all positions of said gauging surface excepting said lock release position.

14. A coin operated lock unit according to claim 13, wherein said coin counting means is adjustable to vary the number of movements thereof required to permit movement of said gauging surface into said lock release position.

15. A coin operated lock unit comprising in combination:

a patron controlled lock movable between unlocked and locked positions;

a coin chute having opposite side wall portions and opposite edge portions cooperating to constrain coins to pass on edge downwardly therethrough;

a lock bolt coupled to said patron lock for movement between unlocked and locked positions incident to movement of said patron lock between said unlocked and locked positions thereof; and a mechanism for performing a coin gauging and counting operation, said mechanism being responsive to insertion of a preselected number of coins of a given diameter within said coin chute for freeing said patron lock for movement between said unlocked and locked positions thereof, said mechanism including a pivotally supported pawl having a coin gauging surface projecting into said coin chute through one of said side wall portions adjacent one of said edge portions and a ratchet element, a release lever carried by said pawl, a counting means including plate means supported for movement along a path of travel from and for return to a first position, said plate means having first and second columns of offset ratchet teeth bounding associated recesses, said recesses of said first column being of essentially uniform depth, as measured transversely of said path of travel excepting a release recess of greater depth disposed adjacent one end of said first column arranged relatively adjacent said first position of said plate means, a bias tending to pivot said pawl for movement in a first direction for normally positioning said ratchet element within recesses of said first column, said gauging surface assuming a gauging position when said ratchet element is received within a recess of said first column other than said release recess in which it is spaced from the other of said edge portions through a distance less than said given diameter but greater than the diameter of coins of smaller denomination of a like currency, said gauging surface being movable against said bias away from said other of said edge portions into a coin release position determined by movement of said ratchet element into said recesses of said second column only incident to passage of a coin of said given diameter downwardly through said coin chute between said gauging surface and said other of said edge portions, said gauging surface assuming a lock release position when said ratchet element is received within said release recess in which it is spaced from said other of said edge portions through a distance less than said distance, wherein movement of the ratchet element from within any given recess of said first column into a recess of said second column against said bias and subsequent return under said bias for receipt within a recess of said first column adjacent to said given recess completes one coin counting cycle of said coin gauging and counting operation during which said plate means undergoes one unit of travel in a direction away from said first position thereof, whereby said preselected number of coins is determined by the number of units of travel of said plate means required to position said release recess for receipt of said ratchet element, said release lever is disposed for abutting engagement by said patron lock to prevent movement thereof from said unlocked into said locked position thereof for all positions of said gauging surface excepting said lock release position, and reset means for returning said plate means to said first position to initiate said coin gauging and counting operation, and said release lever is movable relative to said pawl during return movement of said plate means to said first position.

16. A coin operated lock unit according to claim 15, wherein the last said means includes a pivotally supported return lever coupled to said patron lock by a tension member and arranged to drive said plate means for return to said first position as an incident to movement of said patron lock from said unlocked position thereof into said locked position thereof.

17. A coin operated lock unit according to claim 16, wherein said lock unit additionally includes a pivotally supported coin return lever for accommodating said lock unit for free operation, said coin return lever having upper and lower coin arresting lugs projecting into said coin chute, said coin return lever having a first position corresponding to said unlocked position of said patron lock, wherein said upper lug is arranged in a first position for interrupting passage of a coin of said given diameter, while permitting said coins of smaller denomination to pass downwardly through said coin chute, and a second position corresponding to said locked position of said patron lock, wherein said upper lug is retracted from said first position thereof and said lower lug is moved into an arresting position for arresting passage of a coin of said given diameter whose passage was previously arrested by said upper lug, said lower lug being retracted from said arresting position thereof upon return of said coin return lever to said first position thereof to release said coin of said given diameter previously arrested thereby, and movement of said coin return lever between said first and second positions thereof is controlled by said patron lock via said return lever.

18. A coin operated lock unit according to claim 15, wherein said plate means includes a slide plate and a ratchet plate carried by said slide plate for movement therewith and defining said columns of ratchet teeth, said reset means engaging said slide plate to return said slide and ratchet plates to said first position, and said ratchet plate is adjustably fixed to said slide plate to adjustably vary said number of units of travel required to position said release recess for receipt of said ratchet element.

19. A coin operated lock unit according to claim 15, wherein said lock unit additionally includes a custodian lock, drive means for normally coupling said lock bolt to said patron lock for movement therewith, and drive means control means under the control of said custodian lock for uncoupling said lock bolt from said patron lock and effecting movements of said lock bolt back and forth between said locked and unlocked positions thereof, while said patron lock is in said locked position thereof.

20. A coin operated lock unit according to claim 19, wherein said patron lock includes a patron lock barrel supported by said patron lock for rotation between unlocked and locked positions corresponding to said unlocked and locked positions of said patron lock, said barrel having a latch surface and an arm; and said drive means includes a sleeve supported by said patron lock for rotation independently of said barrel and having a drive connection with said lock bolt, a latch arm supported for pivotal movement relative to said sleeve and normally biased into engagement with said latch surface for releasably drivingly coupling said sleeve for rotational movement with said barrel as same rotates towards said locked position thereof for moving said lock bolt into said locked position thereof and return means carried by said sleeve and arranged for engagement by said arm for releasably drivingly coupling said sleeve for rotational movement with said barrel as same rotates toward said unlocked position thereof for effecting movement of said lock bolt into said unlocked position thereof, said control means is removably drivingly coupled to said latch arm for removing same from engagement with said latch surface and thereafter effecting rotational movements of said sleeve back and forth between said locked and unlocked positions thereof independently of said barrel, and said release lever is disposed for abutting engagement by said arm.

21. A coin operated lock unit according to claim 20, wherein said control means includes a plate mounted for sliding movement under the control of said custodian lock between first and second positions, said plate mounting first and second arms spaced apart in alignment with the direction of said sliding movements, said arms are spaced from said latch arm when said plate is in said first position, and said first and second arms are alternatively drivingly coupled to said latch arm incident to said sliding movements of said plate from and for return to said first position.

22. A coin operated lock unit according to claim 21, wherein said lock unit additionally includes latch means for releasably retaining said lock unit mounted within a locker cabinet and said plate is drivingly coupled to said latch means for moving same between latched and unlatched positions thereof incident to movement of said plate between said first and second positions thereof.

23. A coin operated lock unit according to claim 22, wherein said lock unit additionally includes means removably insertable between said side wall portions for defining said other of said edge portions and selectively varying said distance thereof from said gauging surface when in said gauging position.

24. In a coin operated lock unit of the type having a coin insertion slot communicating with an upper end of a coin chute bounded by opposite side wall portions and opposite edge portions cooperating to cause coins inserted through said coin insertion slot into said upper end of said coin chute to pass downwardly on edge therethrough, the improvement for adapting said lock unit for operation by coins of a desired given diameter comprising an elongated member hving a surface defining one of said edge portions, at least one of said side wall portions and said member having cooperating slot and rib means for removably slidably supporting said member for insertion lengthwise of said coin chute to removably position said surface from the other of said edge portions through a distance exceeding said given diameter and cooperating resiliently deformable means for removably retaining said member in inserted position.

25. The improvement according to claim 24, wherein said lock unit further includes a casing having in part a side wall defining one of said opposite side wall portions and a bottom wall joined to said side wall and cooperating therewith to define a coin discharge slot communicating with a lower end of said coin chute, and said member is removably inserted through said discharge slot.

26. The improvement according to claim 25, wherein said rib and slot means includes a mounting rib defined by said member and a plurality of mounting slots opening downwardly through said discharge slot, and said mounting rib is removably inserted selectively within said slots for varying the spacing between said surface and said other of said edge portions.

27. The improvement according to claim 26, wherein said mounting slots are defined by said one of said opposite side wall portions, said resiliently deformable means is defined by a locking slot extending transversely of lower ends of said mounting slots adjacent said discharge slot and a locking rib arranged adjacent a lower end of said member for removable snap-fit receipt within said locking slot, and said member is provided with a notch adjacent said locking slot, said notch is accessible through said discharge opening for use in withdrawing said member from within said mounting slots.

28. The improvement according to claim 24, wherein said slot and rib means cooperate to removably support said member in a plurality of positions in which said surface is spaced at varying distances from said other edge portion.

29. The improvement according to claim 28, wherein said slot and rib means includes a rib defined by said member and a plurality of mounting slots formed in one of said side wall portions, and said resiliently deformable means includes a locking slot extending transversely of said mounting slots adjacent a discharge end of said coin chute and a locking rib carried by said member for removable snap-fit receipt within said locking slot.

30. The improvement according to claim 24, wherein said lock unit additionally includes means for limiting the size of coins inserted through said coin insertion slot; and the last said means includes a lever arranged between said side wall portions and adjustment means, said lever having an end thereof disposed remotely of said coin insertion slot supported for pivotal movement whereby an opposite end thereof disposed relatively adjacent said coin insertion slot may be swung vertically of said coin insertion slot for varying the effective size thereof, and said adjustment means includes apertures extending through one of said side wall portions for alignment selectively with at least one aperture formed in said opposite end of said lever and a fastener device removably positioned within aligned ones of said apertures.

31. A coin operated lock unit adapted for installation in a locker cabinet for use in releasably locking a door associated with a storage compartment of said locker cabinet in a closed condition, said lock unit comprising in combination:

a casing including a front plate having apertures and a coin insertion slot extending therethrough, a closure plate spaced rearwardly of said front plate, side and opposite side plates extending between said front and closure plates, and upper and lower plates extending between said front, closure, side and opposite side plates;

a guide plate fixed within said casing and cooperating with said side plate to bound opposite sides of a vertically extending coin chute downwardly through which coins are caused to pass on edge, said coin insertion slot communicating with an upper end of said coin chute and said lower plate has a coin discharge slot communicating with a lower end of said coin chute;

a patron key operated patron lock supported within one of said apertures of said front plate and having unlocked and locked conditions;

a custodian key operated custodian lock supported within another of said apertures in said front plate and having locked and unlocked conditions;

a lock bolt supported by said front plate for movement between extended/locking and retracted/unlocking positions, said side plate having a slot extending therethrough for permitting passage of said lock bolt between said positions thereof;

means for coupling said lock bolt to said patron lock barrel for effecting movement thereof between said extended/locking and retracted/unlocking positions incident to movement of said patron lock between said locked and unlocked conditions thereof, respectively;

constraining means for normally constraining said patron lock against movement from said unlocked into said locked condition thereof;

means responsive to depositing of a preselected number of coins of a given diameter in said coin chute for preventing operation of said constraining means and including adjustable means for varying said preselected number of coins, and said opposite side plate is apertured to provide access to said adjustable means;

means under the control of said custodian lock for effecting movement of said lock bolt between said extended/locking and retracted/unlocking positions while said patron lock is in said locked position thereof;

latching means under the control of said custodian lock for locking said lock unit with said cabinet including a pair of latch plates movable between latched and unlatched positions, said upper and lower plates having guide slots extending therethrough for permitting passage of said latch plates between said positions thereof; and means removably insertable upwardly within said guide chute through said coin discharge slot for adjustably varying said given diameter.

32. A coin operated lock unit according to claim 31, wherein said patron lock includes a patron lock barrel supported by said patron lock for rotation between unlocked and locked positions corresponding to said unlocked and locked positions of said patron lock, said barrel having a latch surface and an arm; and said means for coupling said lock bolt to said patron lock includes a sleeve supported by said patron lock for rotation independently of said barrel and having a drive connection with said lock bolt, a latch arm supported for pivotal movement relative to said sleeve and normally biased into engagement with said latch surface for releasably drivingly coupling said sleeve for rotational movement with said barrel as same rotates towards said locked position thereof for moving said lock bolt into said locked position thereof and return means carried by said sleeve and arranged for engagement by said arm for releasably drivingly coupling said sleeve for rotational movement with said barrel as same rotates toward said unlocked position thereof for effecting movement of said lock bolt into said unlocked position thereof, and said means under the control of said custodian lock is removably drivingly coupled to said latch arm for removing same for engagement with said latch surface and thereafter effecting rotational movements of said sleeve back and forth between said locked and unlocked positions thereof independently of said barrel.

33. A coin operated lock unit according to claim 32, wherein said constraining means is in the form of a coin gauging means projecting into said coin chute and movable only in response to the passage of a coin of said given diameter downwardly therethrough and said means responsive to depositing of said preselected number of coins is in the form of a coin counting means movable incident to said movement of said gauging means for counting the number of coins of said given diameter passing downwardly through said coin chute, said gauging means being normally disposed for blocking engagement with said patron lock to prevent movement into said locked position thereof, and said counting means permits movement of said gauging means from blocking engagement with said patron lock only upon counting of a preselected number of coins of said given diameter.

34. A coin operated lock unit according to claim 33, wherein said means removably insertable within said coin chute includes an elongated member having a surface defining one of a pair of opposite edge portions of said coin chute, said member and said side wall plate having cooperating slot and rib means for removably slidably supporting said member for insertion lengthwise within said coin chute and cooperating resiliently deformable means for removably retaining said member in inserted position.

35. The improvement according to claim 34, wherein said lock unit additionally includes means for limiting the size of coins inserted through said coin insertion slot; and the last said means includes a lever arranged between said side and guide plates and adjustment means, said lever having an end thereof disposed remotely of said coin insertion slot supported for pivotal movement whereby an opposite end thereof disposed relatively adjacent said coin insertion slot may be swung vertically of said coin insertion slot for varying the effective size thereof, and said adjustment means includes apertures extending through said side plate for alignment selectively with at least one aperture formed in said opposite end of said lever and a fastener device removably positioned within aligned ones of said apertures.

* * * * *

UNITED STATES PATENT AND TRADEMARK OFFICE

CERTIFICATE OF CORRECTION

PATENT NO. : 4,557,365

DATED : December 10, 1985

INVENTOR(S) : Wells F. Stackhouse

It is certified that error appears in the above-identified patent and that said Letters Patent are hereby corrected as shown below:

Col. 2, line 15 - after the hyphen, insert a --3--.

Col. 3, line 29 - "chut" should be --chute--.

Col. 3, line 34 - "whee" should be --where--.

Col. 8, line 43 - "Moroever" should be --Moreover--.

Col. 12, line 48 - "loer" should be --lower--.

Col. 12, line 61 - "of" should be --by--.

Col. 12, line 67 - "detect" should be --detent--.

Col. 13, line 54 - "portioon" should be --portion--.

Col. 13, line 62 - "83e'" should be --84e'--.

Col. 21, line 15 - "hving" should be --having--.

Signed and Sealed this

*Eighteenth* Day of *March 1986*

[SEAL]

*Attest:*

DONALD J. QUIGG

*Attesting Officer*

*Commissioner of Patents and Trademarks*